United States Patent [19]

Harper

[11] Patent Number: 4,850,069

[45] Date of Patent: Jul. 25, 1989

[54] KNEELING AID

[75] Inventor: Stanley J. Harper, Victoria, Australia

[73] Assignee: Metad Pty. Ltd., Melbourne, Australia

[21] Appl. No.: 124,150

[22] PCT Filed: Aug. 7, 1986

[86] PCT No.: PCT/AU86/00230

§ 371 Date: Aug. 19, 1987

§ 102(e) Date: Aug. 19, 1987

[87] PCT Pub. No.: WO87/03461

PCT Pub. Date: Jun. 18, 1987

[30] Foreign Application Priority Data

Dec. 19, 1985 [AU] Australia ..... PH04044

[51] Int. Cl.[4] ..... E04G 1/00

[52] U.S. Cl. ..... 5/443; 403/61; 403/116; 182/129; 182/230

[58] Field of Search ..... 5/443; 182/129, 230; 297/187, 426, 438, 439; 403/61, 116

[56] References Cited

U.S. PATENT DOCUMENTS

| | | | |
|---|---|---|---|
| 830,103 | 9/1906 | Rundell | 182/230 |
| 1,041,147 | 10/1912 | Murphy | 403/61 |
| 1,529,498 | 3/1925 | Novak | 182/230 |
| 2,318,416 | 5/1943 | Peirce | 297/187 X |
| 2,683,069 | 7/1954 | Kimmel | 403/61 |
| 2,838,353 | 6/1958 | Emmert | 403/61 |

FOREIGN PATENT DOCUMENTS

| | | | |
|---|---|---|---|
| 762869 | 12/1956 | United Kingdom | 182/230 |

*Primary Examiner*—Alexander Grosz
*Assistant Examiner*—Michael F. Trettel
*Attorney, Agent, or Firm*—Pollock, Vande Sande & Priddy

[57] ABSTRACT

A kneeling aid for household or garden use in the form of a platform or board with upstanding handles by means of which work required to be done in a kneeling or near kneeling position may be accomplished. The platform has an upper padded surface (9) and handles (16) at opposite ends thereof for assuming or arising from the kneeling posture. The handles (16) have elongated slots engaging hinge pins (15) in support members (8). This slot-and-pin arrangement allows locking of the handles in the upright position consequent to downward sliding of the handles in supports (8), while raising of the handles permits them to be pivoted into cut-outs (10) so that the handles can lie folded onto the platform.

6 Claims, 6 Drawing Sheets

KNEELING AID

FIELD OF THE INVENTION

The present invention relates to a device in the form of a kneeling aid particularly, but not exclusively, for household or garden use, and comprises a kneeling platform or board by means of which work required to be done in a kneeling or near kneeling position may be more comfortably and efficiently accomplished, while also providing means for aiding the person using the device in assuming the kneeling position and arising therefrom.

SUMMARY OF THE INVENTION

According to the invention, there is provided a kneeling aid comprising a base part having a resilient or padded upper kneeling surface, said base part being provided with handles at opposite ends thereof which are adapted to be grasped by a person in assuming or arising from the kneeling position or for maintaining balance during the kneeling posture, said handles being hingedly mounted on the base part so as to be movable from an upright releasably lockable position to a collapsed position on the base part.

The handles may be hingedly and slidably mounted in upstanding support members integral with or secured to and adjacent the rear corners of the base part, and pivot means such as pivot pins may be provided in the upstanding support members and engageable in elongated slots in the portion of the handles engageable in said support members which are provided on their inner facing upper ends with cut-out portions, said handles being slidable downwardly in said support members to lock same in their upright position and movable upwards through said slots to a position wherein they can be pivoted inwardly into said cut-out portions to a collapsed position above said base part.

According to another embodiment of the invention, the support members are located adjacent the front corners of the base part.

BRIEF DESCRIPTION OF THE DRAWINGS

In order that the invention and its manner of performance may be more fully understood, reference will now be made to embodiments of the invention as illustrated in the accompanying drawings, wherein.

DESCRIPTION OF PREFERRED EMBODIMENTS

Figure 1:
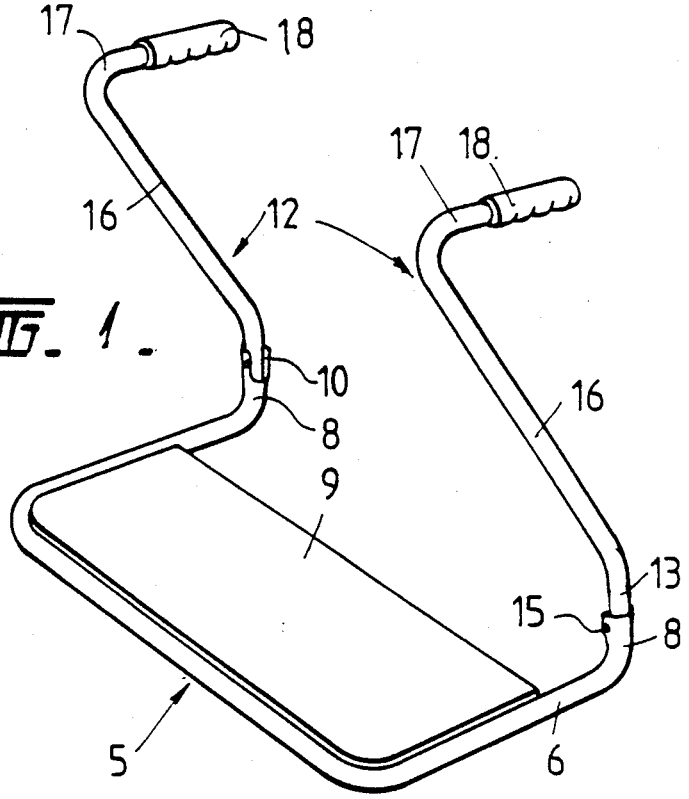
FIG. 1 is a perspective view from above and to the front left hand side of a first embodiment of the device.
Figure 2:
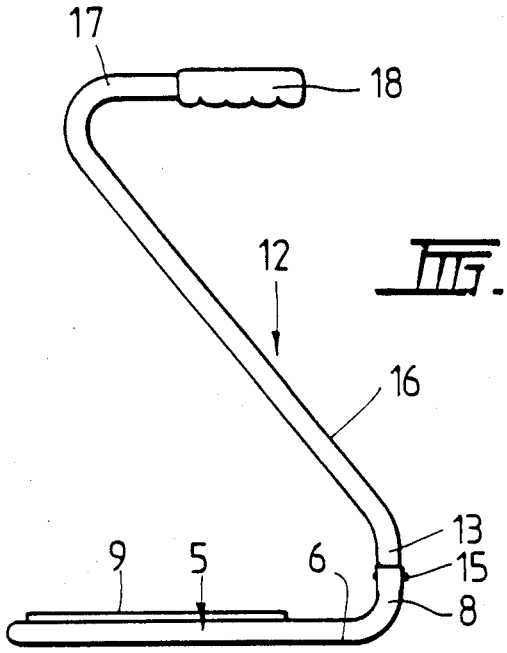
FIG. 2 is a side elevational view.
Figure 3:
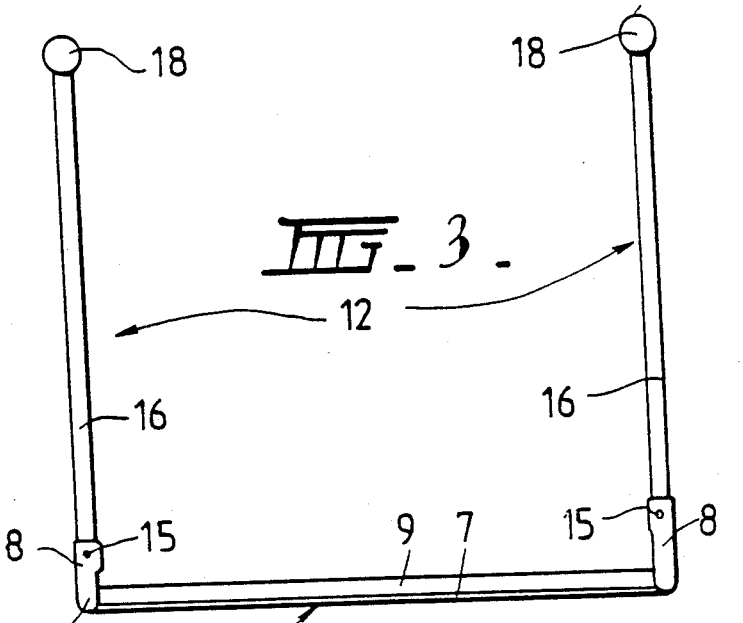
FIG. 3 is a rear elevational view.

Referring to FIGS. 1 to 6 of the drawings, the device comprises a rectangular base member 5 comprising a tubular U-shaped frame 6 having a flat bottom part 7 attached thereto and having upstanding socket members 8 at the rear corners thereof, said socket members 8 being preferably formed as an integral part of tubular frame 6. Located on the bottom part 7 is a pad 9 of resilient plastic material.

The upstanding socket members 8 are each provided with a cut-out portion 10 preferably formed with a lip portion 11 (FIG. 5), said cut-out portions 10 being formed on the inwardly facing surfaces of the socket members 8.

Handles 12 are provided with a portion 13 having an elongated closed slot 14 formed therein, and said socket members 8 are each provided with a pivot pin 15 engageable through said closed slot 14 of a handle 12. The handle portion 16 above said portion 13 is angled towards the front of the device and at its upper end extend rearwardly at 17 to form a handle engaging part provided with suitable resilient grip members 18.

Figure 4:
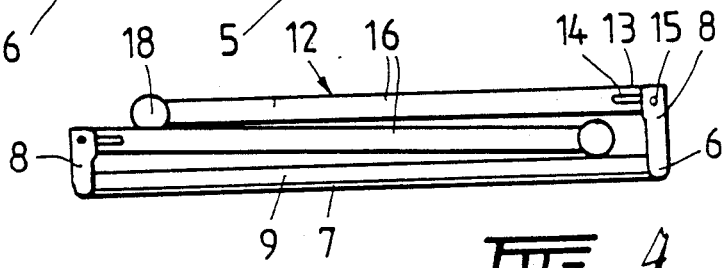
FIG. 4 is a rear elevational view of the device of FIG. 1 in the collapsed folded configuration.

As shown in FIG. 1, with the handles in the upright in-use position, the handle portions 13 are engaged in the socket members 8 with the pivot pins 15 engaging the top end of the slots 14. To collapse the handle 12 onto or above the base member 5, for carrying, stowage or packaging purposes, the handles 12 are lifted upwards in socket members 8 until the pivot pins engage against the lower end of the slots and the handles can then be pivoted inwardly, one above the other as illustrated in FIG. 4.

Figure 7:
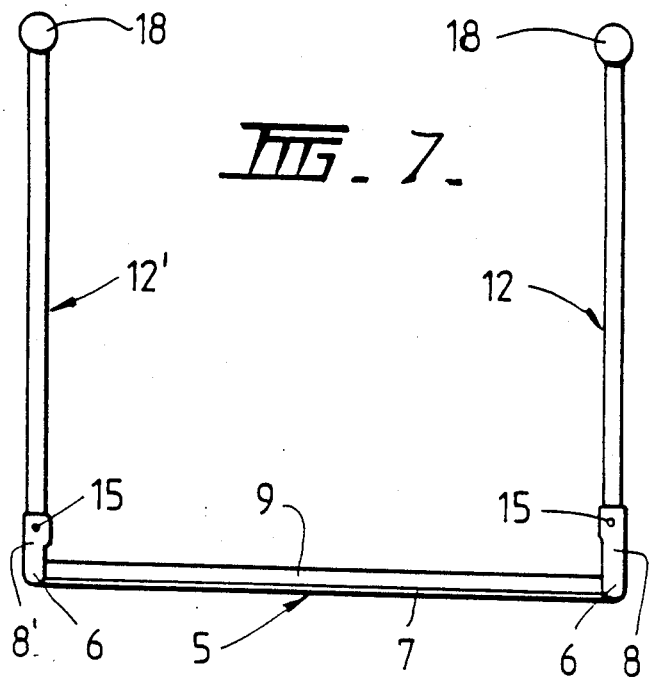
FIG. 7 is a rear elevational view similar to FIG. 3 of a second embodiment of the invention.
Figure 8:
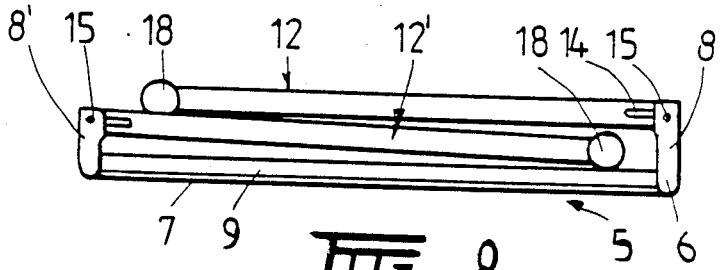
FIG. 8 is a rear elevational view of the device of FIG. 7 in the collapsed folded configuration.

FIGS. 7 and 8 show a modified form of the device of the invention, wherein one socket member 8 is longer than the other socket member 8' and handle 12 is shorter than handle 12', so that when the handles are hinged to the collapsed position, a more compact folded configuration is obtained, as illustrated in FIG. 8.

Figure 5:
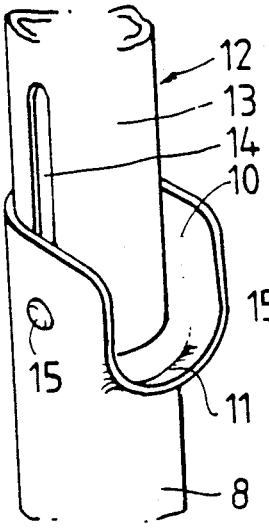
FIG. 5 is a detail view of the hinge connection with a handle in the uppermost position prior to pivoting to a collapsed position.
Figure 6:
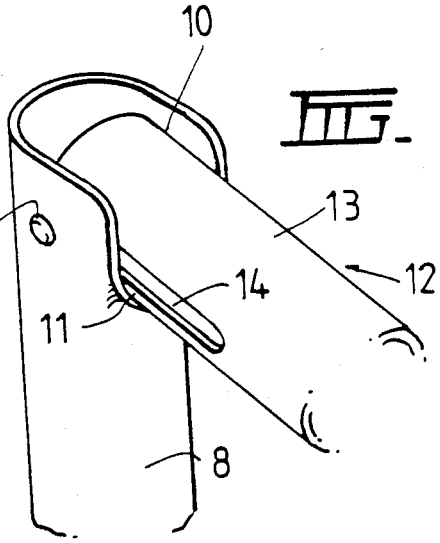
FIG. 6 is a detail view of the hinge connection with a handle in the collapsed configuration.
Figure 9:
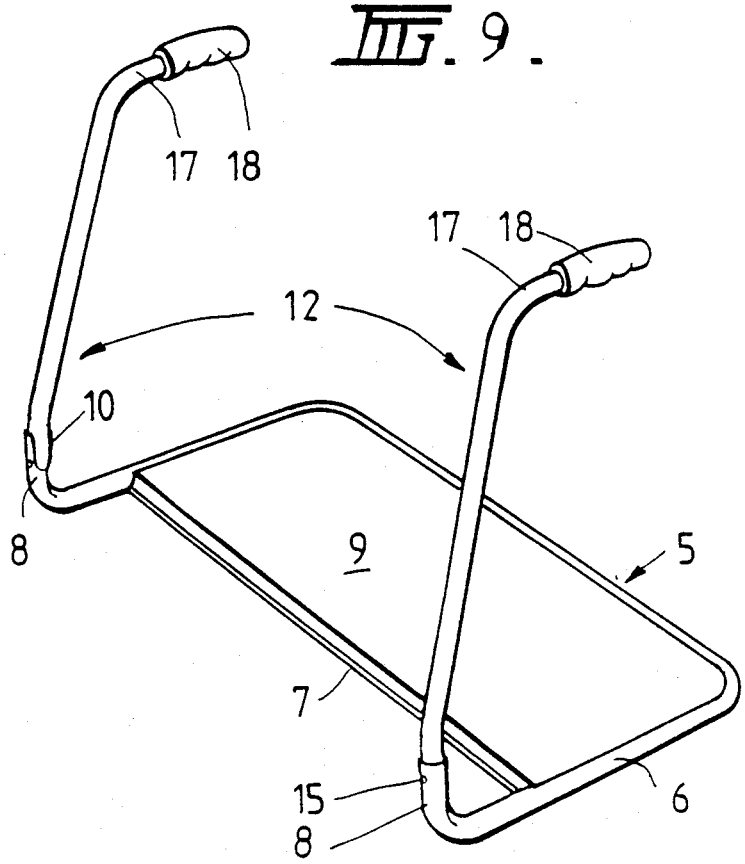
FIG. 9 is a perspective view from above and to the front left hand side of a third embodiment of the device.
Figure 10:
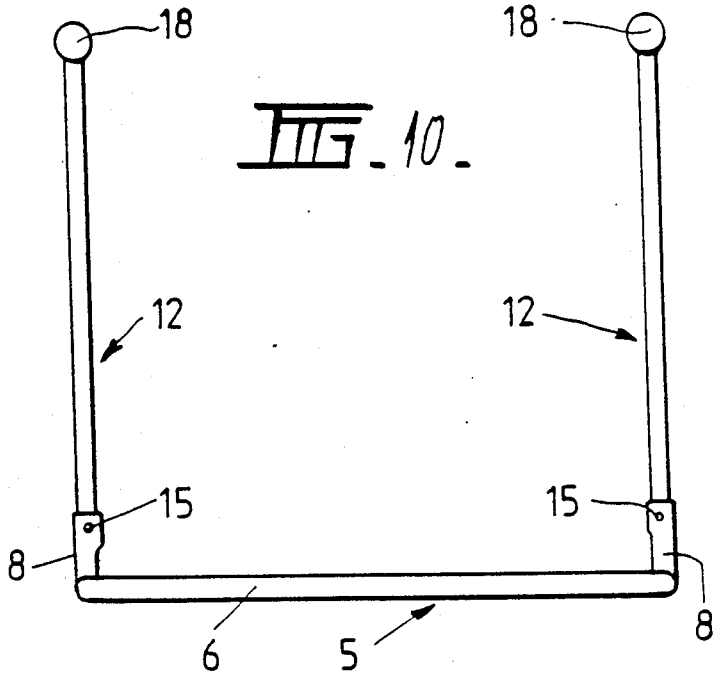
FIG. 10 is a rear elevational view.
Figure 11:
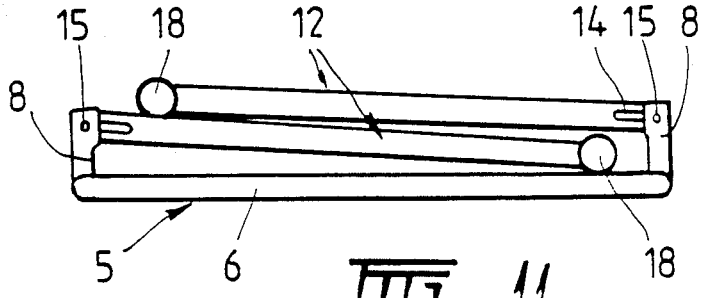
FIG. 11 is a rear elevational view of the device of FIG. 9 in the collapsed folded configuration.

The embodiment shown in FIGS. 9 to 11 is of similar construction to the embodiment of FIGS. 1 to 6, but with the socket members 8 located at the front of the base member 5, and wherein the preferred hinge construction is as illustrated in FIGS. 5 and 6. The locking of the handles in the upright position and inward pivoting of the handles to the collapsed position is as described with relation to FIGS. 1 to 6. The feature of FIGS. 7 and 8 may also apply to this embodiment.

Figure 12:
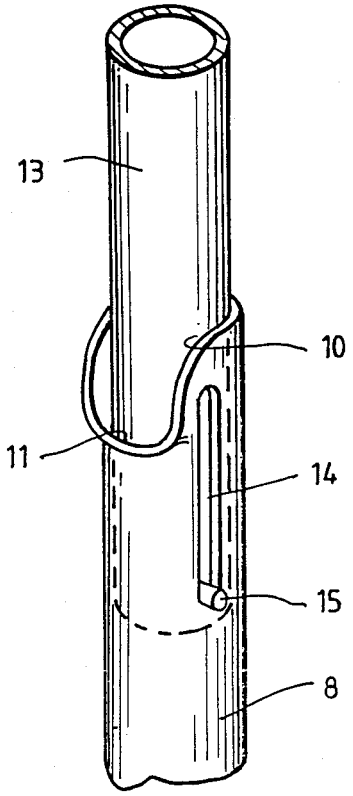
FIG. 12 is a detailed view of another embodiment of the hinge connection with a handle in the uppermost position prior ro hinging to a collapsed position.
Figure 13:
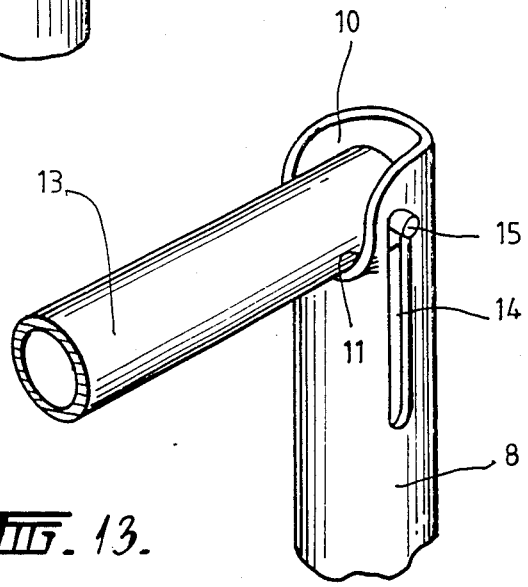
FIG. 13 is a detailed view of the hinge connection of FIG. 12 with a handle in the collapsed position.

Instead of slot 14 being located in handle 12 and pin 15 in socket 8, the slot may be formed in socket 8 and pin 15 secured in portion 13 of handle 12. This embodiment is illustrated in FIGS. 12 and 13.

What is claimed is:

1. A kneeling aid device comprising (a) a base plate having a resilient upper kneeling surface;

(b) a U-shaped tubular framework attached to and surrounding a first side of said base plate and both ends of said base plate, and terminating at ends of said framework on either side of said user in upstanding support members;

(c) a tubular handle, adapted to be grasped by a human hand, hingedly mounted in each of said support members and extending obliquely upward away from said second side and terminating in a substantially horizontal portion extending back toward said second side;

(d) a pin-and-slot connection between said support members and handles to permit pivoting movement from an upright releasably lockable position to a collapsed position on said base plate;

(e) cut-out portions on inwardly facing upper ends of said support members, said handles being movable upwardly to a position from which they can be pivoted inwardly into said cut-out portions to said collapsed position on said base plate.

2. A kneeling aid according to claim 1 wherein said cut-out portions are provided with supporting lip portions.

3. A kneeling aid according to claim 1 wherein one of said support members is longer than the other and one handle is shorter than the other to provide a compact folded configuration in the collapsed position of the handles.

4. A kneeling aid according to claim 1, wherein said pin-and-slot connection comprises pivot pins in said support members engageable in elongated slots in portions of said handles engageable in said support members.

5. A kneeling aid according to claim 1, wherein said pin-and-slot connection comprises pivot pins on portions of said handles engageable in said support members engageable in elongated slots in said support members.

6. A kneeling aid device comprising (a) a base plate having a resilient upper kneeling surface;

(b) a U-shaped tubular framework attached to and surrounding a side and both ends of said base plate, and terminating at ends of said framework in upstanding support members;

(c) a tubular handle, adapted to be grasped by a human hand, hingedly mounted in each of said support members for pivoting movement from an upright releasably lockable position to a collapsed position on said base plate;

(d) a pin-and-slot connection between said support members and handles to permit the pivoting movement; and (e) cut-out portions on inwardly facing upper ends of said support members, said handles being movable upwardly to a position from which they can be pivoted inwardly into said cut-out portions to said collapsed position on said base plate;

(f) wherein said handles are hingedly mounted at rear corners of said base plate and extend forwardly and upwardly in their locked position and rearwardly at upper ends of said handles to form a handle engaging part.

* * * * *